US009361864B2

(12) United States Patent
Parker

(10) Patent No.: US 9,361,864 B2
(45) Date of Patent: Jun. 7, 2016

(54) FLATPICK DEVICE

(71) Applicant: Robert Parker, Reno, NV (US)
(72) Inventor: Robert Parker, Reno, NV (US)

( * ) Notice: Subject to any disclaimer, the term of this patent is extended or adjusted under 35 U.S.C. 154(b) by 0 days.
(21) Appl. No.: 14/623,740
(22) Filed: Feb. 17, 2015
(65) Prior Publication Data
US 2015/0243264 A1 Aug. 27, 2015

Related U.S. Application Data
(60) Provisional application No. 61/966,531, filed on Feb. 26, 2014.
(51) Int. Cl.
*G10D 3/16* (2006.01)
(52) U.S. Cl.
CPC ..... *G10D 3/163* (2013.01)
(58) Field of Classification Search
CPC ..... G10D 3/163
See application file for complete search history.

(56) References Cited

U.S. PATENT DOCUMENTS 557,293 A * 3/1896 Wahl ..... G10D 3/163 84/322
1,263,740 A * 4/1918 Burdwise ..... G10D 3/163 84/322
2,776,592 A * 1/1957 Di Preta ..... G10D 3/163 84/322
3,442,169 A * 5/1969 Bowers ..... G10D 3/163 84/322
3,648,558 A * 3/1972 Chenette ..... G10D 3/163 84/322
3,699,838 A 10/1972 Montgomery
3,713,622 A * 1/1973 Dinger ..... A61M 39/28 24/102 FC
3,789,720 A * 2/1974 McIntyre ..... G10D 3/163 84/322
4,102,234 A * 7/1978 Brundage ..... G10D 3/163 84/322
4,122,746 A * 10/1978 Freeman ..... G10D 3/163 84/322
4,270,433 A * 6/1981 Adamec ..... B01F 17/0064 84/322
D291,809 S * 9/1987 Jasper ..... 84/322
4,834,096 A * 5/1989 Oh ..... A61B 17/122 606/158
4,867,032 A * 9/1989 Lukehart ..... G10D 3/163 84/322
5,109,576 A * 5/1992 Teekell ..... B65D 33/1675 24/30.5 P
5,973,243 A 10/1999 Christenson
D441,005 S * 4/2001 Parham, Jr. ..... 84/322
6,835,881 B1 * 12/2004 Jackson ..... G10D 3/163 84/320
6,949,700 B1 * 9/2005 Kelly ..... G10D 3/163 84/320
7,312,386 B2 * 12/2007 Sielaff ..... G10D 3/163 84/320
7,435,889 B1 * 10/2008 Heidt ..... G10D 13/003 84/320
8,492,630 B1 * 7/2013 Wonnacott ..... G10D 3/163 84/320
2009/0139384 A1 * 6/2009 Bramucci ..... G10D 3/163 84/322
2009/0229442 A1 * 9/2009 Hollin, Jr. ..... G10D 3/163 84/322
2010/0180748 A1 * 7/2010 Fredrick ..... G10D 3/163 84/322
2012/0247304 A1 * 10/2012 Jay ..... G10D 3/163 84/322
2015/0243264 A1 * 8/2015 Parker ..... G10D 3/163 84/322

* cited by examiner

*Primary Examiner* — Robert W Horn
(74) *Attorney, Agent, or Firm* — Fish & Richardson P.C.

(57) ABSTRACT

Methods, systems, and apparatus for a flatpick device is in the present application. The flatpick device includes a front face and a back face, the flatpick includes first and second bores through the flatpick extending from the front face to the back face. Also included is a band with a first distal end and a second distal end, the first distal end extending from the front face to the back face through a first bore and the second distal end extending from the front fact to the back face though the second bore.

5 Claims, 7 Drawing Sheets

FLATPICK DEVICE

CROSS-REFERENCE TO RELATED APPLICATIONS

This application claims the benefit under 35 U.S.C. §119 (e) of U.S. Patent Application No. 61/966,531, entitled "A device consisting of a rubber or elasticized band affixed to a flatpick to hold the pick in place on the thumb," filed Feb. 26, 2014. The disclosure of the foregoing application is incorporated herein by reference in its entirety for all purposes.

BACKGROUND

This specification relates to flatpick devices.

Flatpicks are generally used to play stringed instruments, for example, a guitar. Musicians using a flatpick to play stringed instruments may lose grasp of the flatpick while playing, or in some instances, the musician may desire to use the hand that is grasping the flatpick to adjust or perform another task (e.g., adjust the volume of a speaker). In such instances, the musician may desire to secure the flatpick to their finger or thumb in a manner that conveniently allows the musician to resume using the flatpick quickly and easily.

While some flatpicks allow for fastening to a digit, the fasteners are cumbersome. Furthermore, when playing the instrument, many musicians want to keep the feel and functionality of a common flatpick when using a flatpick that fastens to a digit.

SUMMARY

In general, one innovative aspect of the subject matter described in this specification can be embodied in an apparatus that includes a flatpick device. The flatpick device includes a front face and a back face, the flatpick includes first and second bores through the flatpick extending from the front face to the back face. Also included is a band with a first distal end and a second distal end, the first distal end extending from the front face to the back face through a first bore and the second distal end extending from the front fact to the back face though the second bore.

Another innovative aspect of the subject matter described in this specification can be embodied in an apparatus that includes a flatpick with a front face and a back face, the flatpick including at least one bore through the flatpick extending from the front face to the back face. Also included is a fastening device with a front end including a front face portion and a first fastening portion, and a back end including a back face portion and a second fastening portion, the second fastening portion connected with the first fastening portion and at least one of the first fastening portion and the second fastening portion extendable through the at least one bore of the flatpick. Additionally, a band connected to the back end and forming a loop is included.

Another innovative aspect of the subject matter described in this specification can be embodied in an apparatus that includes a flatpick with a front face and a back face, and a conformable elastic band connected to the back face of the flatpick.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
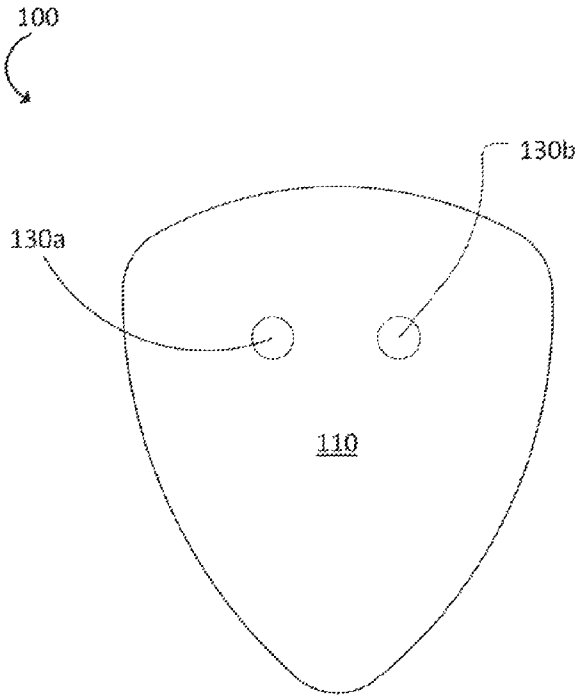
FIG. 1 is an illustration of an implementation of a flatpick device.

FIG. 1 is an illustration of an exemplary implementation of a flatpick device 100. The flatpick device 100 includes a front face 110 and a back face 120 (the latter being illustrated in FIG. 2). The shape of flatpick device 100 may vary, and may be of any appropriate shape for a chosen instrument. In the implementation of FIG. 1, the flatpick device 100 is of a traditional flatpick shape that is an acute isosceles triangle with the two equal corners rounded and the third corner less rounded.

Materials for flatpick device 100 can include one or more of plastic (e.g., nylon celluloid, etc.), rubber, felt, tortoiseshell, wood, metal, glass, tagua, or stone, among others. The implementation of FIG. 1 includes two bores, 130*a* and 130*b*; however, other implementations may include more or fewer bores. Additionally, in the current implementation, bores 130*a* and 130*b* are circular shaped; however, and other shapes may be used, such as a rectangle or triangle, among others. The location of bores 130*a* and 130*b* are approximately symmetrical relative to the flatpick; however, such locations of the bores 130*a* and 130*b* may be located elsewhere, and asymmetric placement of the bores may be used.

Figure 2:
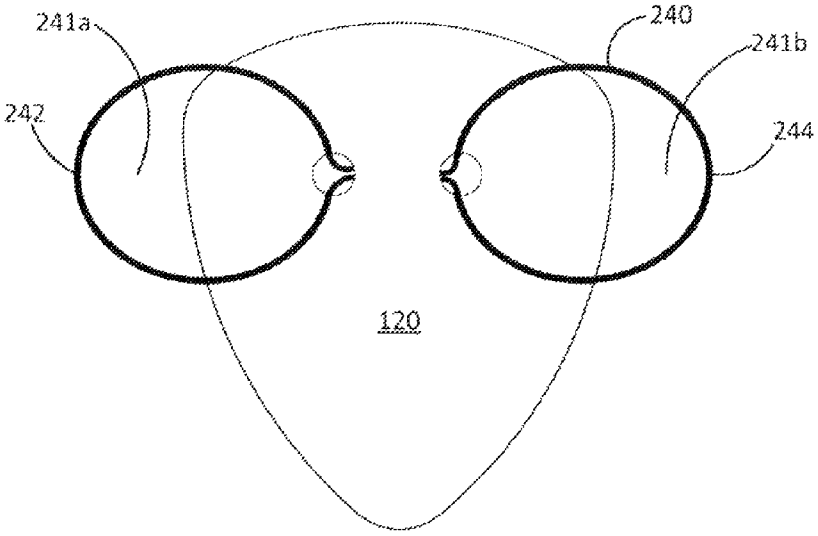
FIG. 2 is an illustration of the implementation in FIG. 1 from the back with an elliptical band.

FIG. 2 is an illustration of the implementation in FIG. 1 from the back face 120 with an elliptical band 240. Elliptical band 240 includes two distal ends 242 and 244, which can be locations on opposite ends of the elliptical band 240. As shown in FIG. 2, the elliptical band 240 begins on the front face 110 side of the flatpick device 100, and distal ends 242 and 244 are extended through bores 130*b* and 130*a*, respectively, from the front face 110 to the back face 120 (or past the back face).

Upon extending distal ends 242 and 244 through bores 130*a* and 130*b*, the distal ends 242 and 244 may be pulled or urged equally or unequally past the back face to create a gap between the back face 120 and distal ends 242 and 244. As shown in FIG. 2, the gaps are loops 241*a* and 241*b*. An individual may then push or slide their finger or thumb through loops 241*a* and/or 241*b*.

The elliptical band 240 enables the flatpick device 100 to adjust to different heights and angles relative to a flatpick user's thumb and/or index finger. For example, the user can move the flatpick device 100 up and down on their thumb relative to bores 130*a* and 130*b*. Also, elliptical band 240 enables a user to rotate the flatpick device 100 at an angle with respect to the user's thumb, index finger, and/or musical instrument.

Figure 4:
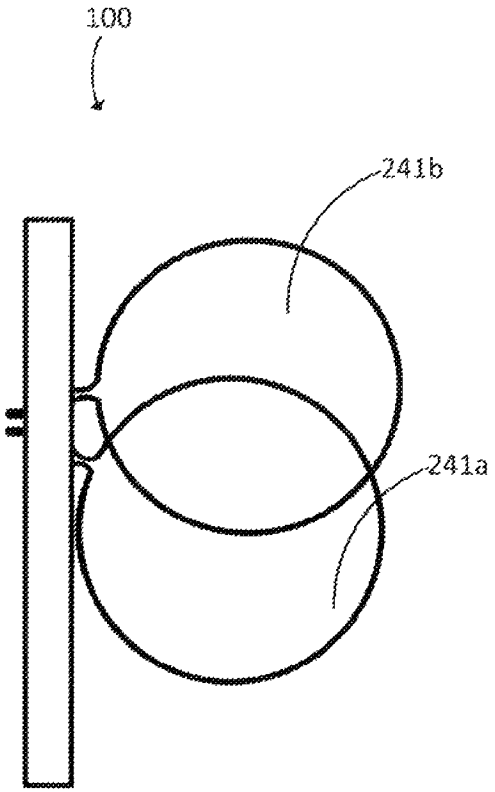
FIG. 4 is an illustration of the implementation in FIG. 1 from the side with the elliptical band.
Figure 3:
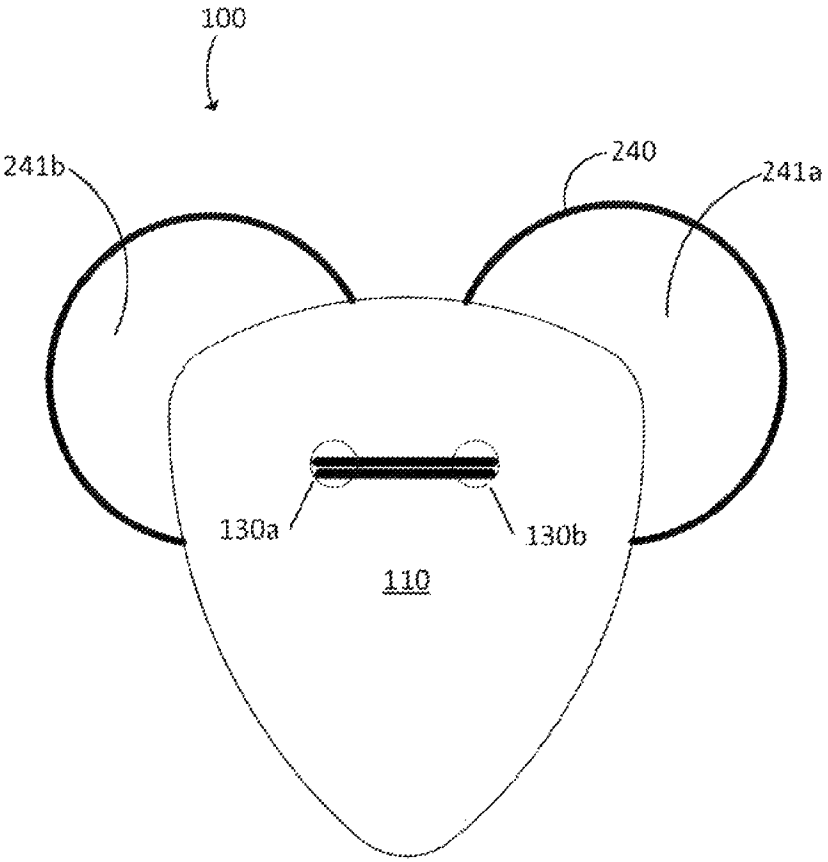
FIG. 3 is an illustration of the implementation in FIG. 1 from the front with the elliptical band.

FIG. 3 is an illustration of the implementation in FIG. 1 from the front face 110 with the elliptical band 240, and FIG. 4 is an illustration of the implementation in FIG. 1 from the side of the flatpick device 100 with the elliptical band 240. Elliptical band 240 in FIG. 3, is pulled across the front face 110, and in the current implementation, elliptical band 240 is contacting front face 110 in one or more locations of the front face 110 between bores 130*a* and 130*b*.

FIG. 4 is an illustration of the implementation in FIG. 2 from the side of the flatpick device 100 with the elliptical band 240.

Figure 5:
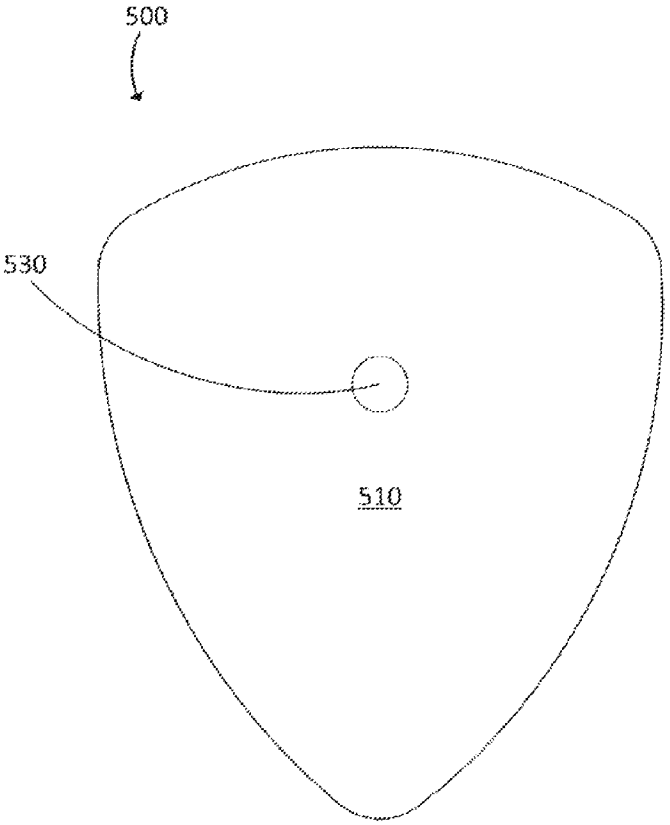
FIG. 5 is an illustration of another implementation of a flatpick device.

FIG. 5 is an illustration of another implementation of a flatpick device 500. Flatpick device 500 includes a front face 510. The implementation of FIG. 5 includes bore 530; however, other implementations may include more or fewer bores. Additionally, in the current implementation, bore 530 is circular shaped; however, this shape is not required and other shapes may be used, such as a rectangle or triangle, among others. The location of bore 530 is approximately symmetrically placed in terms of width relative to the flatpick, however, such a location of the bore 530 is not required, and asymmetric placement of the bores may be used. The bore 530 is placed to receive a fastening device, such as the fastening device of FIG. 6.

Figure 6:
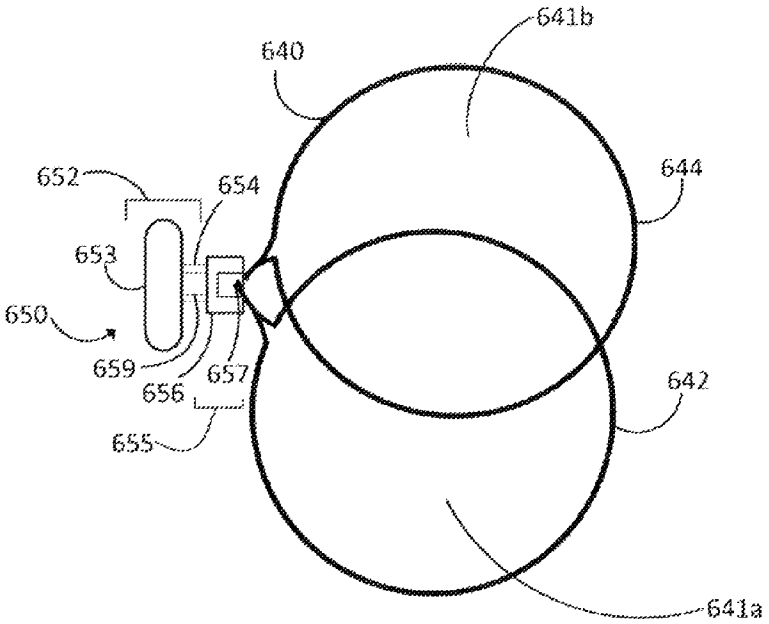
FIG. 6 is an illustration of a fastening device and an elliptical band enabled used with the implementation in FIG. 5.

FIG. 6 is an illustration of a fastening device 650 and an elliptical band 640 configured to be used with the implementation in FIG. 5. Elliptical band 640 can be similar or identical to elliptical band 240. Elliptical band includes distal ends 642 and 644 and loops 641*a* and 641*b*, which are similar to previously described distal ends 242 and 244 and loops 241*a* and 241*b*.

Fastening device 650 includes a front end 652 and a back end 655 that are configured to mate with each other through the bore 530. The front end 652 includes a front facing portion 653 which, when assembled, is configured to be on the front face 510 side of the flatpick device 500, and in some implementations front facing portion 653 may contact front face 510. Front end 652 also includes a fastening portion 654, which is configured to fasten with fastening portion 659 (shown in FIG. 9). In some implementations, fastening portion 654 extends at least partially into bore 530.

Fastening device 650 also includes back end 655, which includes a back face portion 656 and fastening portion 659. Back facing portion 656, in some implementations, includes one or more slots 657 for connecting or fastening elliptical band 640 with fastening device 650. However, such a configuration is not required, and in other implementations other configurations can be used for fastening. Slots 657 can receive one or more portions of elliptical band 640, as described in further detail below. Other types of structures to connect the band to the back end 655 of the fastening device may be used including pins, clips, or adhesives, among others. Fastening portion 659 is configured to connect with fastening portion 654. In the current implementation, fastening portion 659 is configured to connect with fastening portion 654 by fitting inside at least a portion of fastening portion 654, and fastening portion 659, in some implementations, extends at least partially into bore 530.

Figure 7:
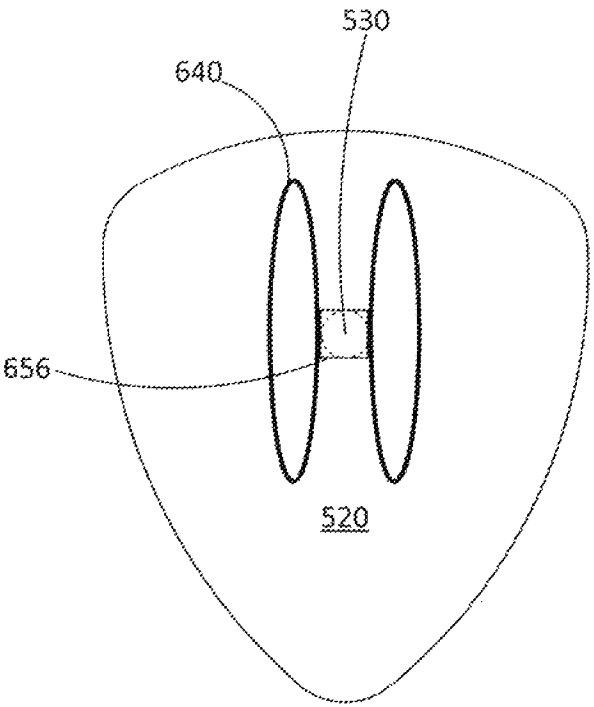
FIG. 7 is an illustration of the implementation in FIG. 5 from the back with an elliptical band.

FIG. 7 is an illustration of the implementation in FIG. 5 from a back view with the fastening device 650 and an elliptical band 640. In the current implementation, the back facing portion 656 of back end 655 is contacting back face 520. Back facing portion 656 includes a greater width or length than that of bore 530 (or diameter). Also, front facing portion 653 may include a greater width or length than that of bore 530 in order to maintain at least a component of the fastening device 650 on each side, front face 510 and back face 520, of the flatpick device 500. As previously described, elliptical band 640 is connected to the back facing portion 656.

Figure 8:
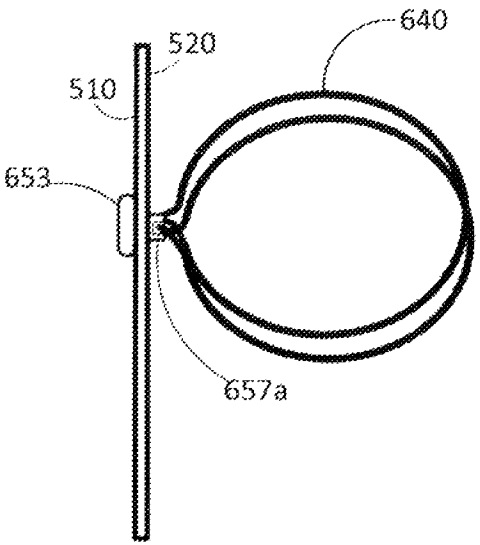
FIG. 8 is an illustration of the implementation in FIG. 5 from the side with an elliptical band.

FIG. 8 is an illustration of the implementation in FIG. 5 from the side with the fastening device 650 and the elliptical band 640. As seen in FIG. 8, front facing portion 653 is contacting front face 510 and back facing portion 656 is contacting back face 520, but such a configuration is not required and other implementations may be used. Also, slot 657*a* receives a portion of elliptical band 640, and a second slot can receive another portion of elliptical band 640, as described below.

Figure 9:
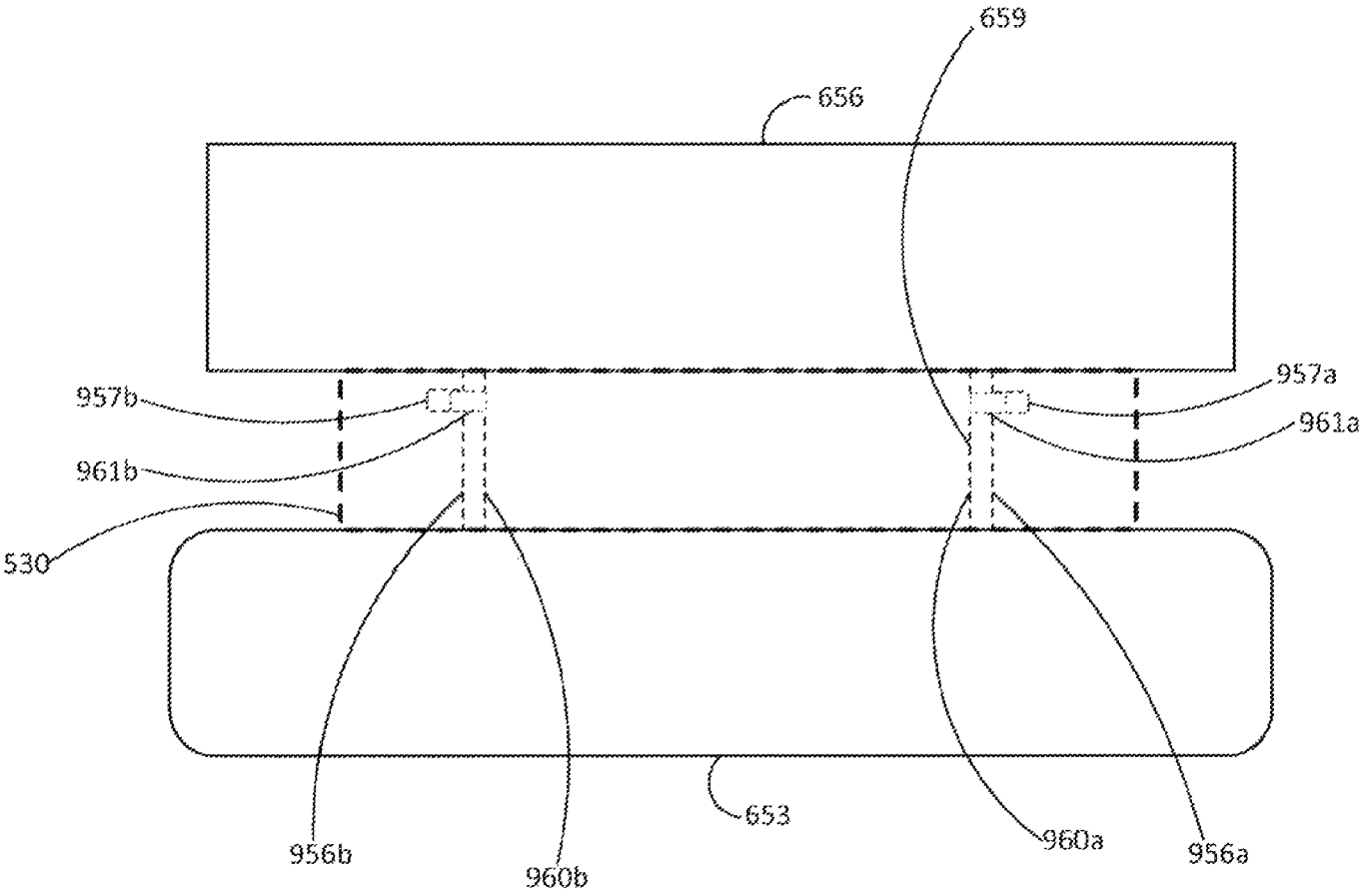
FIG. 9 is an illustration of an implementation of another fastening device enabled to be used with the implementation in FIG. 5.

FIG. 9 is an illustration of an exemplary implementation of fastening device 650 enabled to be used with the implementation in FIG. 5. Fastening device 652 includes front facing portion 653 and fastening portion 654. Fastening portion 654 in the current implementation is hollow with interior side 956*a* and 956*b* shown in FIG. 9. At one or more locations on the interior side 956*a* and 956*b* a cavity is included, which in the current implementation are cavities 957*a* and 957*b*, respectively. Cavities 957*a* and 957*b* may be of any shape, and in some implementations are not symmetrically positioned. The one or more cavity may extend around the entirety of fastening portion 654, or one or more cavity may extend around a portion of interior side 956*a* and/or 956*b*.

Fastening device 655 includes back facing portion 656 and fastening portion 659. Fastening portion 659 includes exterior sides 660*a* and 660*b*. At one or more locations of the exterior sides 660*a* and 660*b*, a protrusion is included, which in the current implementation are protrusions 661*a* and 661*b*, respectively. Protrusions 661*a* and 661*b* may be of any shape and are not required to be symmetrical positioned; however, at least one protrusion is configured to fit within at least one cavity (e.g., 957*a* and 957*b*). The one or more protrusion may extend around the entirety of fastening portion 659, or one or more protrusion may extend around a portion of exterior side 960*a* and/or 960*b*. In the current implementation, protrusion 961*a* is configured to be positioned within cavity 957*a*, and protrusion 961*b* is configured to be positioned within cavity 957*b*. Such a configuration is one implementation of fastening the fastening device 652 to fastening device 655.

Figure 10:
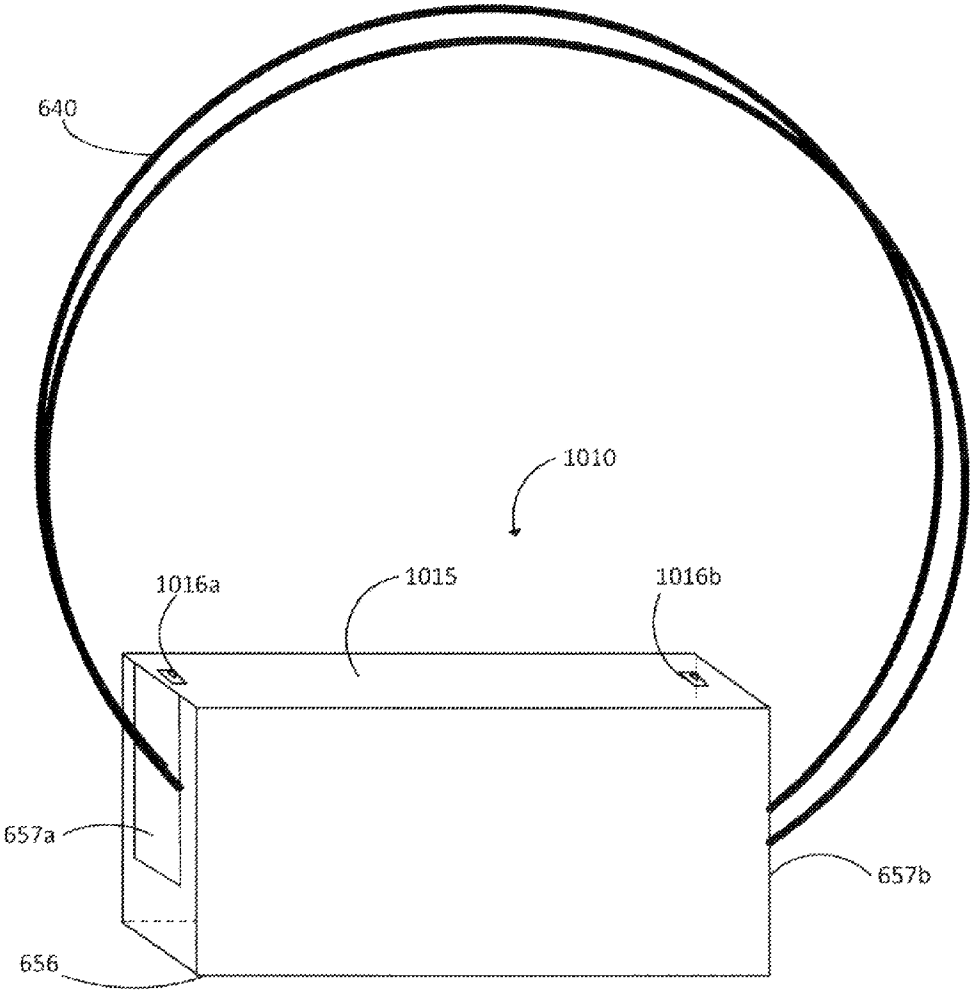
FIG. 10 is an illustration of an implementation of a locking mechanism enabled to be used with the implementation of FIG. 5.

FIG. 10 is an illustration of an exemplary implementation of a locking mechanism enabled to be used with the implementation of FIG. 5. Locking mechanism 1010 is a component of fastening device 655 and specifically back facing portion 656 and is used to lock the band 640 in place to the back portion. Slots 657*a* and 657*b* are configured to receive at least a portion of the elliptical band 640. Latch 1015 is configured to be opened (unlocked) and closed (locked), and when opened latch 1015 allows the at least a portion of the elliptical band 640 to be placed within the back facing portion 656 and through slots 657*a* and 657*b*. Upon closing latch 1015, the elliptical band 640 is hindered from moving away from the back facing portion 656. In the current implementation, latch 1015 includes handles 1016*a* and 1016*b*. An operator may open latch 1015 from its closed position by releasing a biasing mechanism (e.g., a lock, magnet, adhesive, among others) and pulling the handles 1016*a* and 1016*b* away from the back facing portion 656. After inserting at least a portion of the elliptical band 640 in the open back facing portion 656, the operator can replace latch 1015 to close (or lock) the elliptical band 640 within back facing portion 656. In some implementations, only one handle is included and in other implementations more than two handles are included. Also, different mechanisms for latch 1015 and handles 1016*a* and 1016*b* may be included.

Figure 11:
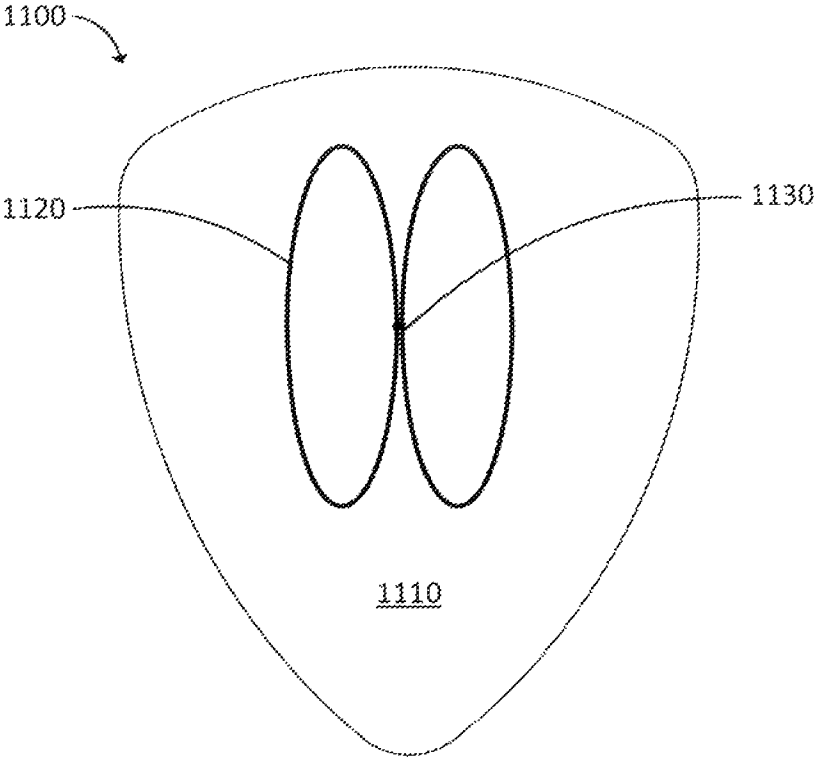
FIG. 11 is an illustration of another implementation of a flatpick device.

FIG. 11 is an illustration of a third implementation of a flatpick device 1100. Elliptical band 1120 is connected to back face 1110. Elliptical band 1120 can include the same or similar components to elliptical bands 240 and 640. Elliptical band 1120 is connected at connection point 1130. The connection point 1130 may include, for example, the locking mechanism of FIG. 10 adhered to by an adhesive to the flatpick 1100. Alternative, the connection point may be realized by directly connecting the band to the back of the pick, which may include one or more adhesives.

Figure 12:
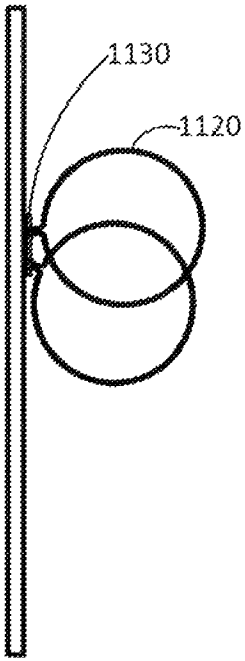
FIG. 12 is an illustration of the implementation in FIG. 11 from the side with an elliptical band.

FIG. 12 is an illustration of the implementation in FIG. 11 from the side. As seen in FIG. 12, elliptical band 1120 is secured to connection point 1130, and connection point 1130 is secured to the back face 1110 of the flatpick device 1100.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. An apparatus, comprising:

a flatpick with a front face and a back face, the flatpick including at least one bore through the flatpick extending from the front face to the back face;

a fastening device, including:

a front end including a front face portion and a first fastening portion; and a back end including a back face portion and a second fastening portion, the second fastening portion connected with the first fastening portion and at least one of the first fastening portion and the second fastening portion extendable through the at least one bore of the flatpick; and a band connected to the back end and forming a loop;

wherein:

the back face portion of the back end includes a locking mechanism to connect the elliptical band with the back end, the locking mechanism includes a slot and a hinged portion that engages over the slot, and the band is received within the slot so that the locking mechanism, when engaged, secures the band within the slot; and the locking mechanism has a width that is greater than a length and a height of the locking mechanism, wherein the slot included in the locking mechanism runs widthwise such that the loop formed by the band is positioned to receive a thumb of a user and secure the flatpick to the thumb such that the locking mechanism runs widthwise parallel to a joint of the user's thumb.

2. The apparatus of claim 1, wherein the front face includes a left side and a right side, the at least one bore being positioned substantially symmetrically between the left side and the right side of the front face.

3. The apparatus of claim 2, wherein the first fastening portion is received by the second fastening portion.

4. The apparatus of claim 3, wherein the first fastening portion includes a first width and the second fastening portion includes a second width that is larger than the first width.

5. The apparatus of claim 4, wherein the first fastening portion includes a fastening protrusion and the second fastening portion includes a cavity, and the protrusion is configured to be positioned within the cavity.

* * * * *